US005380045A

United States Patent [19]

Comann

[11] Patent Number: 5,380,045

[45] Date of Patent: Jan. 10, 1995

[54] METHOD FOR IDENTIFYING AN OBJECT AND THE RESULTING STRUCTURE

[76] Inventor: Tyler K. Comann, 312 Walnut St., San Francisco, Calif. 94118

[21] Appl. No.: 122,735

[22] Filed: Sep. 16, 1993

Related U.S. Application Data

[63] Continuation of Ser. No. 887,617, May 22, 1992, abandoned.

[51] Int. Cl.[6] ..... B42D 15/00

[52] U.S. Cl. ..... 283/70; 283/79; 283/81; 40/310

[58] Field of Search ..... 283/70, 79, 80, 81; 40/310

[56] References Cited

U.S. PATENT DOCUMENTS 1,273,105 7/1918 Van Dyke et al. ..... 40/310 X
2,091,346 8/1937 Wright ..... 40/310 X
3,484,976 12/1969 Shea ..... 283/81 X

FOREIGN PATENT DOCUMENTS 2348595 4/1975 Germany ..... 40/310
2067507 7/1981 United Kingdom ..... 40/310

*Primary Examiner*—Mark Rosenbaum
*Assistant Examiner*—Frances Han
*Attorney, Agent, or Firm*—Skjerven, Morrill, MacPherson, Franklin & Friel

[57] ABSTRACT

A system for allowing a consumer of wine to easily remember the source, name and year of the wine includes a removable label applicable to the wine bottle, the label being removable and capable of being placed on a memorandum of the transaction by which the user acquired the wine such as a sales slip. The label can be attached to the bottle with reusable glue or alternatively with velcro, or some other appropriate means.

4 Claims, 2 Drawing Sheets

METHOD FOR IDENTIFYING AN OBJECT AND THE RESULTING STRUCTURE

This application is a continuation of application Ser. No. 07/887,617, filed May 22, 1992, now abandoned.

FIELD OF THE INVENTION

This invention relates to a method for remembering the identity of an object, such as wine, and to a structure and system for implementing the method.

BACKGROUND OF THE INVENTION

Oftentimes, people at restaurants will drink wine of a known year and vineyard, will like the wine and will want to purchase bottles of the wine for their own use at a later date. Unfortunately, it is sometimes difficult for the waiter or the customer to write down the information necessary to identify properly the wine because of the pressures of other customers, lack of paper, or just forgetfulness. Even if the identity of the wine is written down on paper, the paper is often lost or misplaced. While customers sometimes remove labels from the bottles of wine they wish to drink again, this requires soaking the wine bottle in water and is both cumbersome and time consuming.

Accordingly, there is a need for a way to make it easy for a customer to identify a particular wine which the customer found satisfactory so that the customer can easily repurchase the wine at his or her local liquor store.

SUMMARY OF THE INVENTION

In accordance with this invention, a method and structure are provided which greatly simplify the remembering of a particular commodity (such as a wine which was served at a meal). In accordance with this invention, each commodity such as a bottle of wine is provided with a removable label (either a separate label or part of the regular label) containing thereon selected information, such as in the case of wine, the identification of the vineyard, the type of wine, the year of the wine and the address of the wholesaler or retailer supplying the wine. The label is removable from the commodity and contains a reusable adhesive of a type commonly available so that the label can be placed on a selected receptacle such as the credit card slip or sales receipt associated with the commodity. The purchaser of the commodity then is able to remove the label from the commodity and place the label on the receptacle and thus have a permanent record of the commodity as well as the business establishment at which the commodity was purchased. Because the label is coated at least partly on one side with a reusable adhesive, the label can be further removed from the receptacle and placed on another receptacle, such as, for example, a permanent file.

This invention is capable of being used with any number of commodities to enable the customer to easily retain a record of the particular commodities which the customer wishes to remember.

This invention will be more fully understood in conjunction with the following detailed description taken together with the following drawings.

DETAILED DESCRIPTION

While one embodiment of this invention will be described, other embodiments of this invention will be obvious in view of this description.

Figure 1:
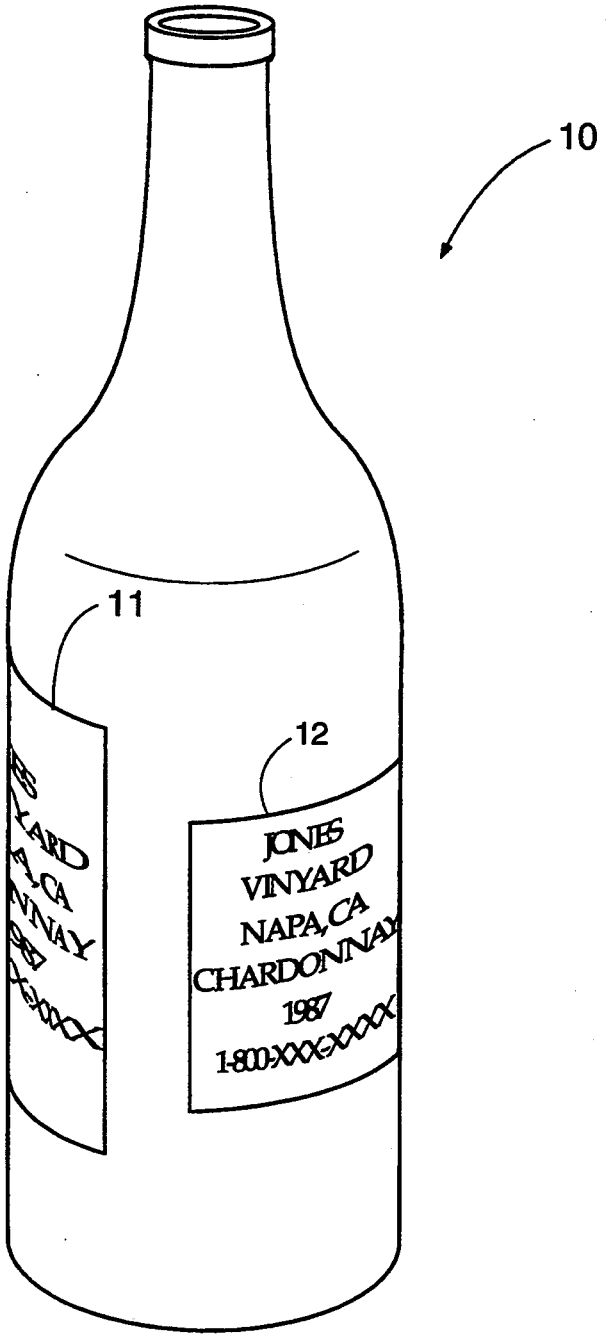
FIG. 1 illustrates a wine bottle with the label of this invention attached to one side thereof with selected information identifying, for example, the vineyard and the year contained thereon.

FIG. 1 illustrates a wine bottle 10 on which is placed a label 11 and a removable label 12 of this invention. On the removable, re-attachable label 12 of this invention is printed sufficient information to identify the particular bottle of wine to which the label was originally attached. This label contains, for example, the name of the vineyard, the year of the wine, the type of wine (for example, Chardonnay, Riesling, Cabernet Savignon or Rose') and the year (for example 1986, 1987). Other information can also be placed on the label if desired such as the location of distributors who sell the wine or a telephone number at which such information can be obtained. The label 12 is placed on the bottle with an adhesive which allows the label to be easily peeled from the bottle but, at the same time, also allows the label to be re-used. Such adhesives are commonly available and are typically used with products such as Post-its TM, a product available from 3M. The user, upon finding a particular wine to be worth repurchasing, can remove the label 12 from the bottle 10 and thus retain that information relating to the wine sufficient to allow the user to again purchase the wine at a later date. Upon receiving the label 12, the user then places the label 12 on the sales receipt 13, or on some other receptacle such as a credit card or a record book thereby retaining a permanent record of the wine. For example, if the user is a wine connoisseur, the user might place the label 12 in a notebook or file retained by the user for this purpose. The advantage of attaching the label 12 to the sales receipt 13 is that the wine is then identified with the restaurant at which the wine was purchased and the sales receipt is generally kept by the customer for tax or other purposes thereby ensuring retention of the identifying label 12 by the customer.

Other techniques are also available for retaining the removable label 12. For example, the label 12 could be placed on the bottle 10 with velcro by attaching a velcro coated material label to the bottle by adhesive or some other appropriate means and then placing a velcro-backed label 12 on velcro coated material. The velcro backed label 12 could then attach to a velcro pad contained in the customer's wallet or a special notebook provided for this purpose. The velcro pad in the wallet could be placed in the wallet by means of a suitable adhesive.

Figure 2:
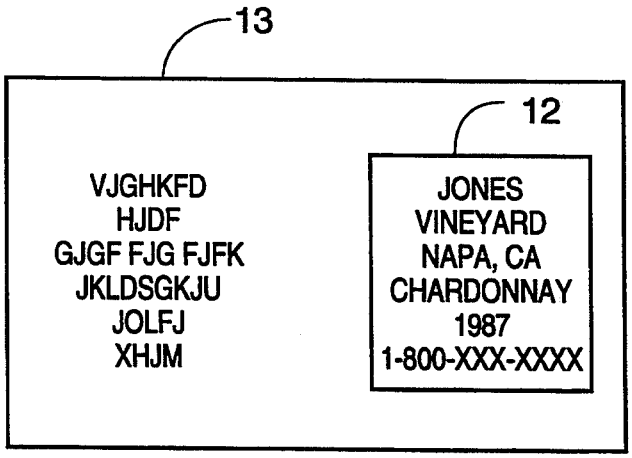
FIG. 2 illustrates the label as removed from the wine bottle and placed on the sales receipt or credit card slip generated by the restaurant upon payment for the meal by the customer.
Figure 3:
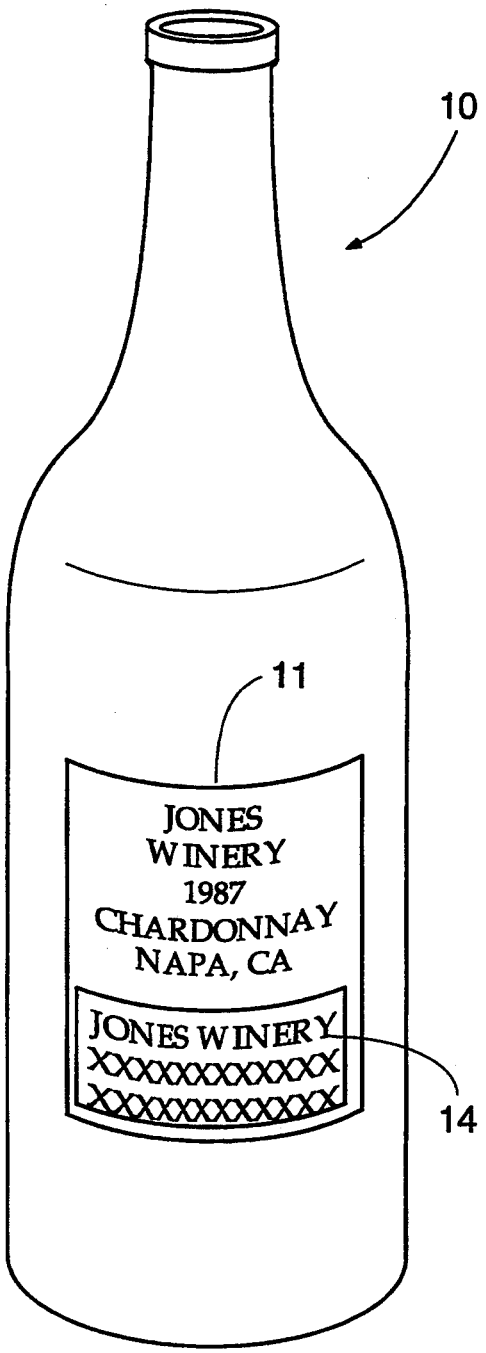
FIGS. 3 and 4 illustrate an embodiment of this invention where the removable label of this invention is part of the regular label on the commodity (a wine bottle).
Figure 4:
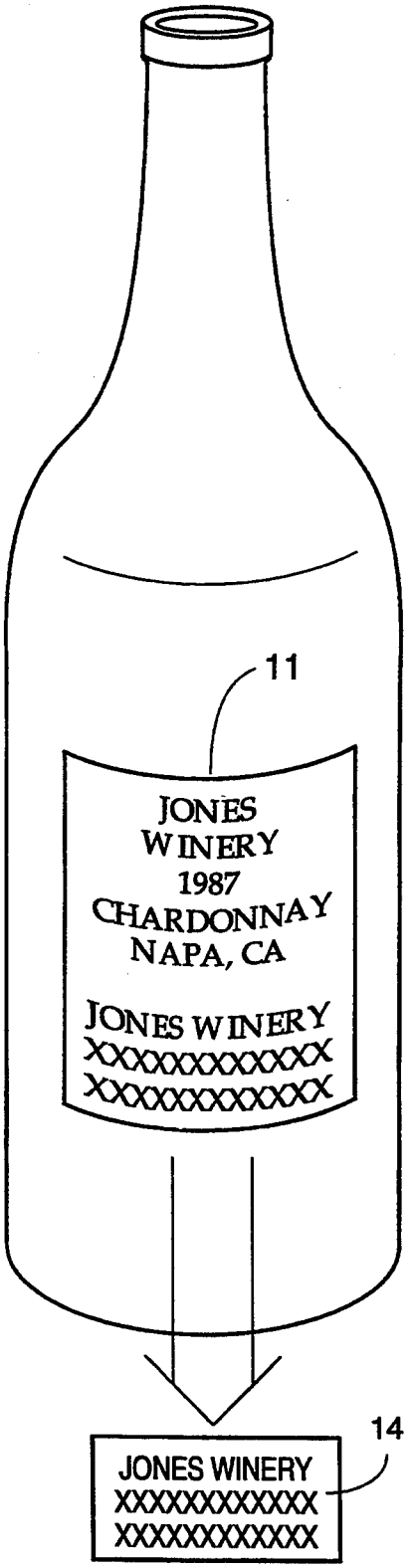

In an alternative embodiment shown in FIGS. 3 and 4, the regular label 11 on the bottle 10 could contain a removable portion 14 containing identifying data in any appropriate form. The removable portion 14 of the label could then be removed from the bottle 10 as shown in FIG. 4 for retention as described above in conjunction with FIGS. 1 and 2. Note that the regular label 11 contains under the removable portion of the label 14 the same information as on the removable label 14.

In another alternative embodiment appropriate bar coded data is placed on the removable label 12 or 14 and later scanned by an appropriate scanner (such as a laser scanner) for reading the information on the label directly into a computer memory. The same information could be placed on the non-removable portion of the regular label 11 on the bottle so that, if convenient, the information on the label could be scanned directly into the computer memory by passing a laser wand past the label and retrieving the information from the laser wand and placing it in the computer memory. The information stored in the computer memory can then be retrieved as desired.

While this invention has been shown in conjunction with a removable label 12 placed on a commodity such as a wine bottle 10, or a removable portion 14 of a label 11 placed on a commodity (FIGS. 3 and 4) a removable label of the type described in this invention can also be used in other contexts. For example, at a concert, the concert goer might hear a particular number played by the orchestra and desire to acquire a recording of that number if that recording is available by the orchestra. Removable labels containing information identifying a particular piece of music can be placed on the concert program next to that particular piece of music in the program so the concert goer can remove these labels from the program and place them either on the ticket to the concert or some other record of the concert for subsequent use in ordering the particular recording desired.

In some situations, a program might contain an order blank to which the removable labels can be attached thereby allowing the concert goer to merely send in the blank to some retailer and receive in the mail a copy of the desired recording.

Other embodiments of this invention will be obvious in view of the above disclosure.

What is claimed is;

1. A method by which a person is able to identify wine in a bottle which comprises:

placing on the wine bottle a label including a removable portion containing selected information for identifying the wine, said information including the name of the winery, the type of wine and the year of the wine, the same information being placed on another portion of the label;

removing the removable portion of the label from the wine bottle; and retaining the removable portion of the label when the wine bottle is discarded thereby enabling the wine to be identified after the wine bottle has been discarded.

2. The method of claim 1 including the step of:

placing the removed portion of the label on a selected receptacle thereby to retain the removed portion of the label together with the receptacle.

3. The method of claim 2 wherein the receptacle comprises a sales receipt provided by the seller of the wine thereby allowing the purchaser of the wine to keep together the removed portion of the label identifying the purchased wine and the sales receipt recording the purchase of the wine.

4. The method of claim 3 wherein the label also includes the address of at least one supplier of the wine.

* * * * *